US007503835B2

(12) United States Patent
Cotton

(10) Patent No.: US 7,503,835 B2
(45) Date of Patent: Mar. 17, 2009

(54) LAWNMOWER BLADE SHARPENER

(76) Inventor: Don Cotton, 3100 Easley Dr., Andalusia, AL (US) 36420

( * ) Notice: Subject to any disclaimer, the term of this patent is extended or adjusted under 35 U.S.C. 154(b) by 0 days.

(21) Appl. No.: 11/672,314

(22) Filed: Feb. 7, 2007

(65) Prior Publication Data

US 2007/0184760 A1 Aug. 9, 2007

Related U.S. Application Data

(60) Provisional application No. 60/765,781, filed on Feb. 7, 2006.

(51) Int. Cl.
*B24B 7/19* (2006.01)

(52) U.S. Cl. ..... 451/45; 451/122; 451/128; 451/141; 451/160; 451/293

(58) Field of Classification Search ..... 451/122, 451/128, 141, 160, 224, 225, 229, 230, 234, 451/235, 248, 293, 45, 51
See application file for complete search history.

(56) References Cited

U.S. PATENT DOCUMENTS

| | | | | | |
|---|---|---|---|---|---|
| 2,377,126 | A | * | 5/1945 | Brown | 451/141 |
| 2,596,098 | A | | 5/1952 | Burnham | |
| 2,718,097 | A | * | 9/1955 | Bradley | 451/141 |
| 2,928,215 | A | * | 3/1960 | Hayden | 451/349 |
| 3,581,446 | A | * | 6/1971 | Witt et al. | 451/421 |
| 3,638,363 | A | * | 2/1972 | Witt et al. | 451/421 |
| 3,726,047 | A | * | 4/1973 | Long | 451/421 |
| 3,811,232 | A | * | 5/1974 | Reuter | 451/421 |
| 4,192,103 | A | * | 3/1980 | Sousek | 451/421 |
| 4,495,734 | A | * | 1/1985 | Rauch | 451/421 |
| 5,209,025 | A | * | 5/1993 | Martin et al. | 451/421 |
| 5,725,415 | A | * | 3/1998 | Bernhard | 451/45 |
| 5,879,224 | A | | 3/1999 | Pilger | |
| 6,010,394 | A | | 1/2000 | Dieck et al. | |
| 2004/0128812 | A1 | | 7/2004 | Beattie | |

OTHER PUBLICATIONS

International Search Report and Written, PCT/US2007/61794 Oct. 23, 2007.

* cited by examiner

*Primary Examiner*—Maurina Rachuba
(74) *Attorney, Agent, or Firm*—Thomas, Kayden, Horstemeyer & Risley, LLP; Todd Deveau

(57) ABSTRACT

In one embodiment, a method of sharpening reel blades on a lawnmower reel includes positioning a grinding wheel in contact with the reel, rotating the grinding wheel about an axis of rotation, linearly translating the grinding wheel along a longitudinal path. and rotating the reel about its longitudinal axis. The axis of rotation of the grinding wheel is transverse to a longitudinal axis of the reel.

13 Claims, 8 Drawing Sheets

LAWNMOWER BLADE SHARPENER

CROSS-REFERENCE TO RELATED APPLICATIONS

This application claims priority to U.S. provisional application entitled "Reel blade grinder," which was filed Feb. 7, 2006 and was accorded U.S. Ser. No. 60/765,781 and which is incorporated herein by reference in its entirety.

BACKGROUND

A reel lawnmower is a type of lawnmower that cuts grass using a rotating reel and a bed knife. The reel is a cylinder that has blades extending across its face, each blade being relatively sharp. The bed knife is a planar surface that is also relatively sharp. The reel is mounted on the lawnmower adjacent the bed knife with its longitudinal axis parallel to and just above the bed knife. As the reel lawnmower moves over the grass, the reel rotates about the longitudinal axis, and the reel blades intermittently pass in close proximity to bed knife. If the both the reel blade and the bed knife are relatively sharp, a scissoring effect results such that the top of the grass is cleanly snipped at a consistent height. Such grass cutting is sometimes referred to as turf manicuring.

Routine use may cause the blades on the reel to become worn. For example, FIG. 1 is a perspective view of a reel 101 of the prior art, and FIG. 2 is a partial side view of a reel blade 103 of the reel 101, illustrating a cutting edge 105 and a cutting surface 107 of the reel blade 103. If the cutting edge 105 becomes relatively dull, the reel lawnmower may rip or tear the grass instead of shearing the grass with a scissoring action. Ripping or tearing may reduce the appearance of the grass and may negatively affect the health of the grass plant, which may expend energy repairing the ripped surface instead of maintaining plant color and growth. Further, if the cutting surface 107 becomes relatively uneven, the reel lawnmower may cut at an inconsistent height, which is undesirable where turf manicuring is desired, such as on golf courses.

The problems associated with dull reel blades may be mitigated by periodically sharpening the reel blades 103. One manner of sharpening the reel blades 103 is backlapping, which involves applying a grinding compound while rotating the reel backward at a high speed. However, backlapping may be ineffective to sharpen the reel if the blades are excessively dull or have been nicked by rocks. In such cases, the effectiveness of backlapping may be restored by relief grinding the reel removing metal from an angled relief surface 109 on a back side of the reel blade 103 opposite from the cutting edge 105. The reduced cross-section along the angled relief surface 109 improves the ability of the grinding compound to flow between the reel and bed knife blades during backlapping. Thus, relief grinding is not effective to sharpen the cutting edges 105 or to level the cutting surfaces 107 of the reel blades 103; it merely improves the likelihood of sharpening the reel through subsequent backlapping.

Grinding processes that actually sharpen the cutting edges 105 and level the cutting surfaces 107 include single blade grinding and spin grinding. Both types of grinding involve moving a grinding wheel along the reel blade 103 to sharpen the cutting edge 105 while leveling the cutting surface 107. With single blade grinding, the grinding wheel is moved along an individual reel blade to sharpen its cutting edge 105 and level its cutting surface 107. When the blade is sharp, the reel is rotated and the next reel blade is sharpened. Thus, single blade grinding may be performed without removing the reel from the lawnmower. However, because each reel blade is sharpened independently, single blade grinding may distort the cylindrical shape of the reel, preventing the reel from cutting uniformly.

The reel may be uniformly sharpened by spin grinding the reel. Spin grinding involves contacting the reel with a rotating grinding wheel. The axis of rotation of the grinding wheel is oriented generally parallel to the axis of rotation of the reel, and both the grinding wheel and the reel are rotated at relatively high rotational velocities. One disadvantage of spin grinding is that vibrations result when the wheel and the reel contact each other while spinning at relatively high rotational velocities. The vibrations can be dampened, but the equipment required to perform the dampening makes the spin grinder heavy and expensive. For example, most spin grinding machines are large machines that are integrated into a cabinet or table, much like a table saw, and are normally housed indoors where they are powered using electricity. Because spin grinding machines may be cumbersome to move, the reel unit is normally removed from the lawnmower and transported to the location of the machine for sharpening.

Another disadvantage of the grinding processes summarized above is that these processes may be poorly suited for sharpening rotary lawnmower blades, which are planar blades having a sharp cutting surface on each half of the blade. For example, the spin grinding machine is not designed to accept the rotary lawnmower blade, and single blade grinding may result in relatively uneven sharpening. Additionally, single blade grinding is time-consuming, especially in cases in which multiple blades are to be sharpened. From the above, it is apparent that a need exists in the industry for an improved lawn blade sharpener.

SUMMARY

In one embodiment, a method of sharpening reel blades on a lawnmower reel includes positioning a grinding wheel in contact with the reel, rotating the grinding wheel about an axis of rotation, linearly translating the grinding wheel along a longitudinal path, and rotating the reel about a longitudinal axis of the reel. The axis of rotation of the grinding wheel is transverse to the longitudinal axis of the reel.

In one embodiment, a lawnmower blade sharpener includes a supporting frame, a carriage assembly coupled to the supporting frame, the carriage assembly including a longitudinally extending railway and a carriage slidably mounted on the railway, a grinding wheel coupled to the carriage, the grinding wheel having an axis of rotation that is transverse to the railway, and a powering device coupled to the grinding wheel, the powering device being configured to rotate the grinding wheel about the axis of rotation.

In one embodiment, a rotary blade attachment can be positioned in the sharpener to sharpen rotary blades. The rotary blade attachment includes at least one mounting plate, a clamping mechanism that can be used to couple a rotary blade to the mounting plate, and an adjuster than can be used to level the rotary blade.

In another embodiment, a lawnmower blade sharpener includes a grinding wheel having an axis of rotation, means for rotating the grinding wheel about the axis of rotation, and means for moving the grinding wheel along a path of linear translation. The axis of rotation of the grinding wheel is transverse to the path of linear translation of the grinding wheel, such that when a lawnmower reel is placed in the sharpener with a longitudinal axis of the reel extending along the path of linear translation, the axis of rotation of the grinding wheel is transverse to the longitudinal axis of the reel.

In a further embodiment, a method of sharpening a rotary lawnmower blade includes positioning a lip of a cupped grinding wheel in contact with a cutting surface of the rotary blade, rotating the cupped grinding wheel about an axis of rotation, and linearly translating the cupped grinding wheel along a longitudinal path. The axis of rotation of the cupped grinding wheel is perpendicular to the cutting surface of the rotary blade, and the longitudinal path of the grinding wheel is perpendicular to a longitudinal length of the rotary blade.

Other systems, devices, features, and advantages of the disclosed lawnmower blade sharpener will be or will become apparent to one with skill in the art upon examination of the following drawings and detailed description. All such additional systems, devices, features, and advantages are intended to be included within the scope of the present invention and are intended to be protected by the accompanying claims.

BRIEF DESCRIPTION OF THE DRAWINGS

The present disclosure may be better understood with reference to the following drawings. Matching reference numerals designate corresponding parts throughout the drawings, and components in the drawings are not necessarily to scale.

DETAILED DESCRIPTION

As described above, it may be desirable to have a lawnmower blade sharpener that can sharpen the cutting edges and level the cutting surfaces of reel blades on a reel. Disclosed below are embodiments of such a sharpener. The sharpener has a grinding wheel that is configured to linearly translate along a path of linear translation, and to rotate about an axis of rotation that is generally transverse to the path of linear translation. The grinding wheel contacts a discrete portion of at least one blade on the reel, and as the grinding wheel rotates, the grinding wheel sharpens the cutting edge and levels the cutting surface of the discrete portion. As the grinding wheel moves along the path of linear translation, the grinding wheel sharpens discrete portions located at different positions along a longitudinal length of the reel. The reel is rotated about its longitudinal axis to expose the grinding wheel to discrete portions at different circumferential positions around the reel. With continued rotation and linear translation, the entire reel is sharpened.

Figure 1:
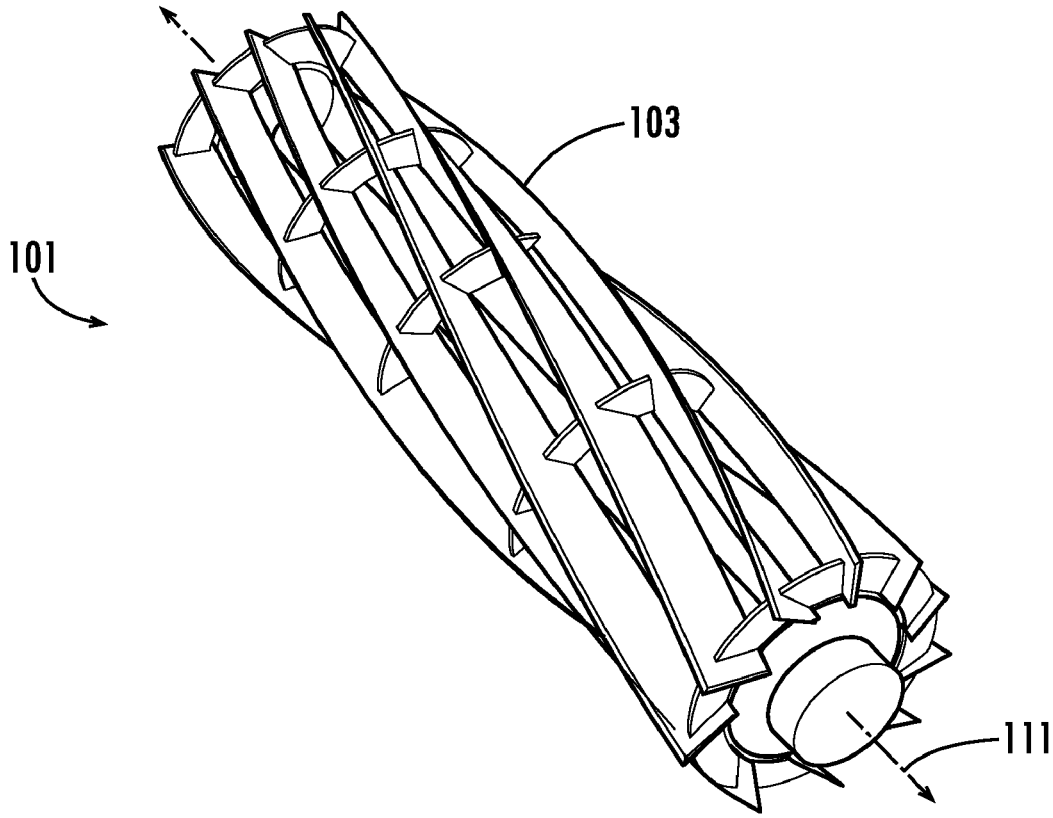
FIG. 1 (PRIOR ART)
FIG. 1 is a perspective view of a lawnmower reel of the prior art.

More specifically, FIG. 1 is a perspective view of a prior art reel 101 that can be sharpened using an embodiment of the lawnmower sharpener disclosed below. As shown, the reel 101 is generally a cylinder having a longitudinal axis 111. Reel blades 103 extend longitudinally along the face of the reel. In most cases, the reel blades 103 are not positioned on the reel 101 parallel to the longitudinal axis 111. Instead, the reel blades 103 spiral about the reel 101 in a helical fashion, as shown in FIG. 1. Alternatively, the reel blades 103 may spiral about the reel 101 in one direction, and may change direction at an apex to spiral in the other direction, forming a chevron pattern (not shown). Further, the reel blades 103 may be slightly twisted in a direction extending radially outward from the longitudinal axis 111 of the reel 101, as shown in FIG. 1.

To sharpen the reel 101 using an embodiment of the lawnmower blade sharpener disclosed below, the reel 101 is removed from the lawnmower and is placed in or adjacent the sharpener. In most cases, an entire reel unit is removed from the lawnmower and is placed adjacent the sharpener. The reel unit includes the reel 101, a bed knife, a rear roller, a front roller, and a casing. The reel blades 103 are exposed on one side of the reel unit, and are covered on the other side of the reel unit by the casing. The reel 101 can rotate about its longitudinal axis 111 within the reel unit. In some cases, the reel 101 is removed from the reel unit for sharpening, but in other cases the entire reel unit is placed in the sharpener.

Figure 3:
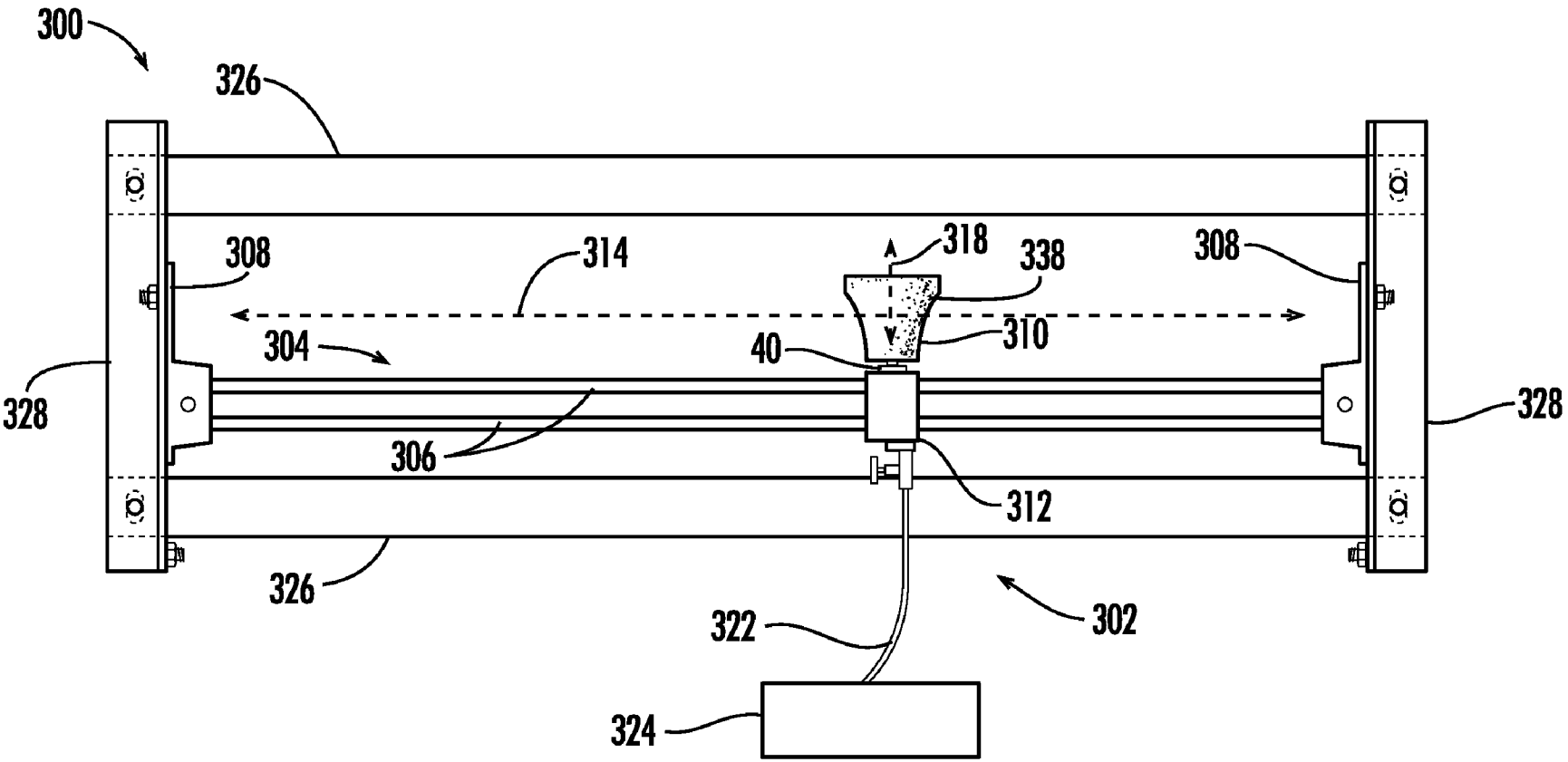
FIG. 3 is a top plan view of an embodiment of a lawnmower blade sharpener of the present disclosure.
Figure 4:
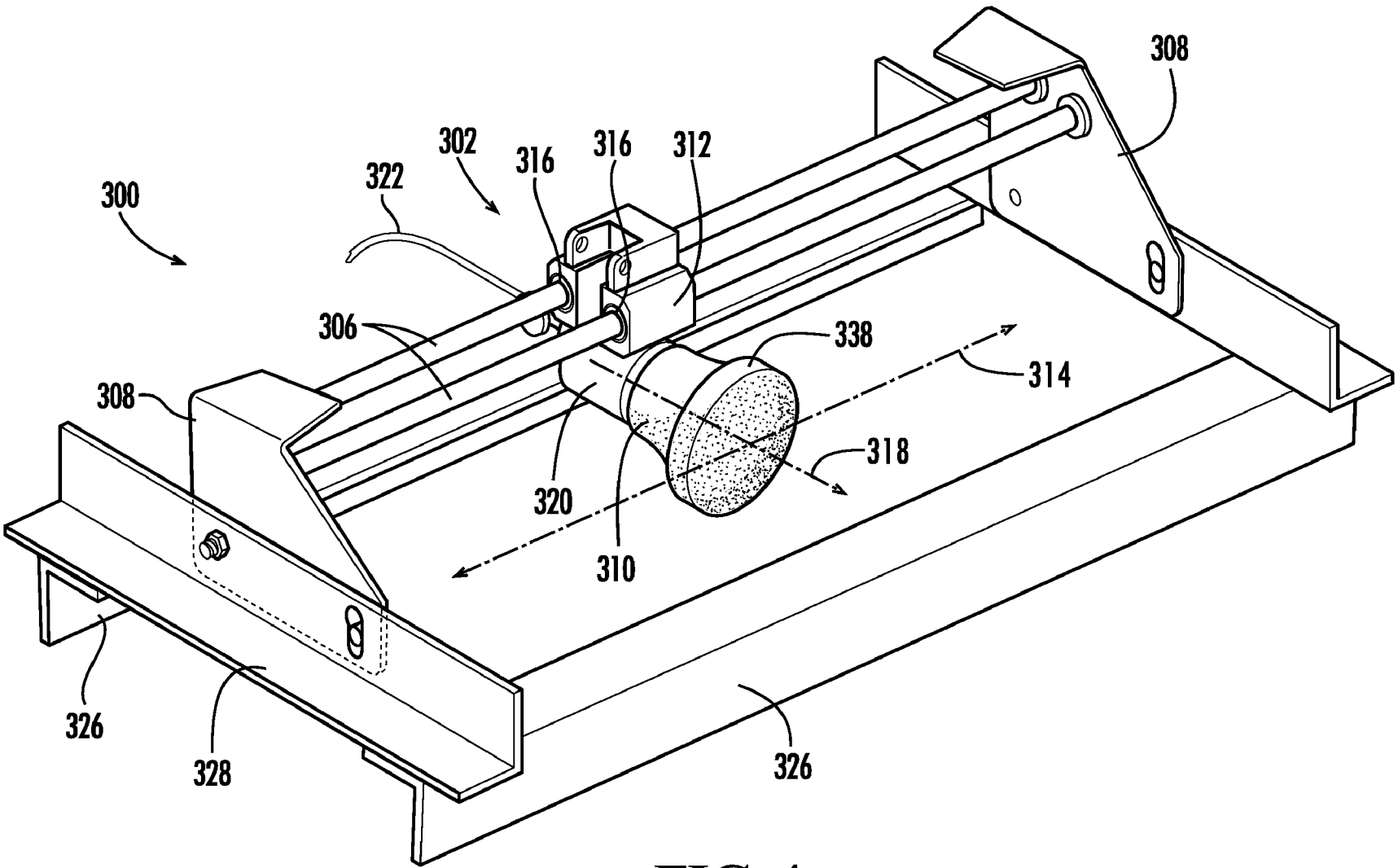
FIG. 4 is a perspective view of the lawnmower blade sharpener shown in FIG. 3.

FIG. 3 is a top view of an embodiment of a lawnmower blade sharpener 300, and FIG. 4 is a perspective view of the lawnmower blade sharpener 300 shown in FIG. 3. As shown, the sharpener 300 includes a supporting frame 302, and a carriage assembly 304 supported by the supporting frame 302. The carriage assembly 304 has a railway 306 that extends between supports 308 on the supporting frame 302. A carriage 312 is positioned on the railway 306, and the grinding wheel 310 is coupled to the carriage 312. The railway 306 defines a path of linear translation 314 of the carriage 312.

For the purposes of this disclosure, the term "railway" connotes a rail or track structure configured to support the carriage 312, such that moving the carriage 312 along the railway 306 moves the carriage 312 along the path of linear translation 314. In some cases, the railway 306 is further configured to stay true, so that the carriage 312 does not deviate from the path of linear translation 312 as it moves. In the illustrated embodiment, the railway 306 includes a plurality of elongated rods that are substantially parallel to each other. The rods are cylindrical, and therefore a plurality of rods are provided to maintain the carriage 312 along the path of linear translation 314. In other embodiments, the railway 306 can have other configurations. For example, greater or fewer rods can be provided. The rods can also have other shapes, such as non-circular shapes, in which case the carriage 312 may run true even if only one rod is provided. The railway 306 may also be a track mechanism, a beam, or any other structure or mechanism known in the art.

In embodiments in which the railway 306 includes one or more rods, the carriage 312 has an opening 316 for each rod that is shaped to mate with the rod, and the carriage 312 is mounted on the rod by passing the rod through the opening 316, as shown in FIG. 4. The illustrated openings 316 are cylindrically shaped to mate with the cylindrical rods, although openings 316 of other shapes could be used.

With reference back to FIG. 3, the carriage 312 is movable with respect to the railway 306 in a direction of movement that is parallel to the railway, which moves the grinding wheel 310 along the path of linear translation 314. Therefore, the carriage assembly 304 is a means for moving the grinding wheel 310 along the path of linear translation 314. In other embodiments, other such means can be employed. For example, the grinding wheel 310 can be mounted on a track system or a pulley system that enables moving the grinding wheel 310 along the path of linear translation 314.

Figure 5:
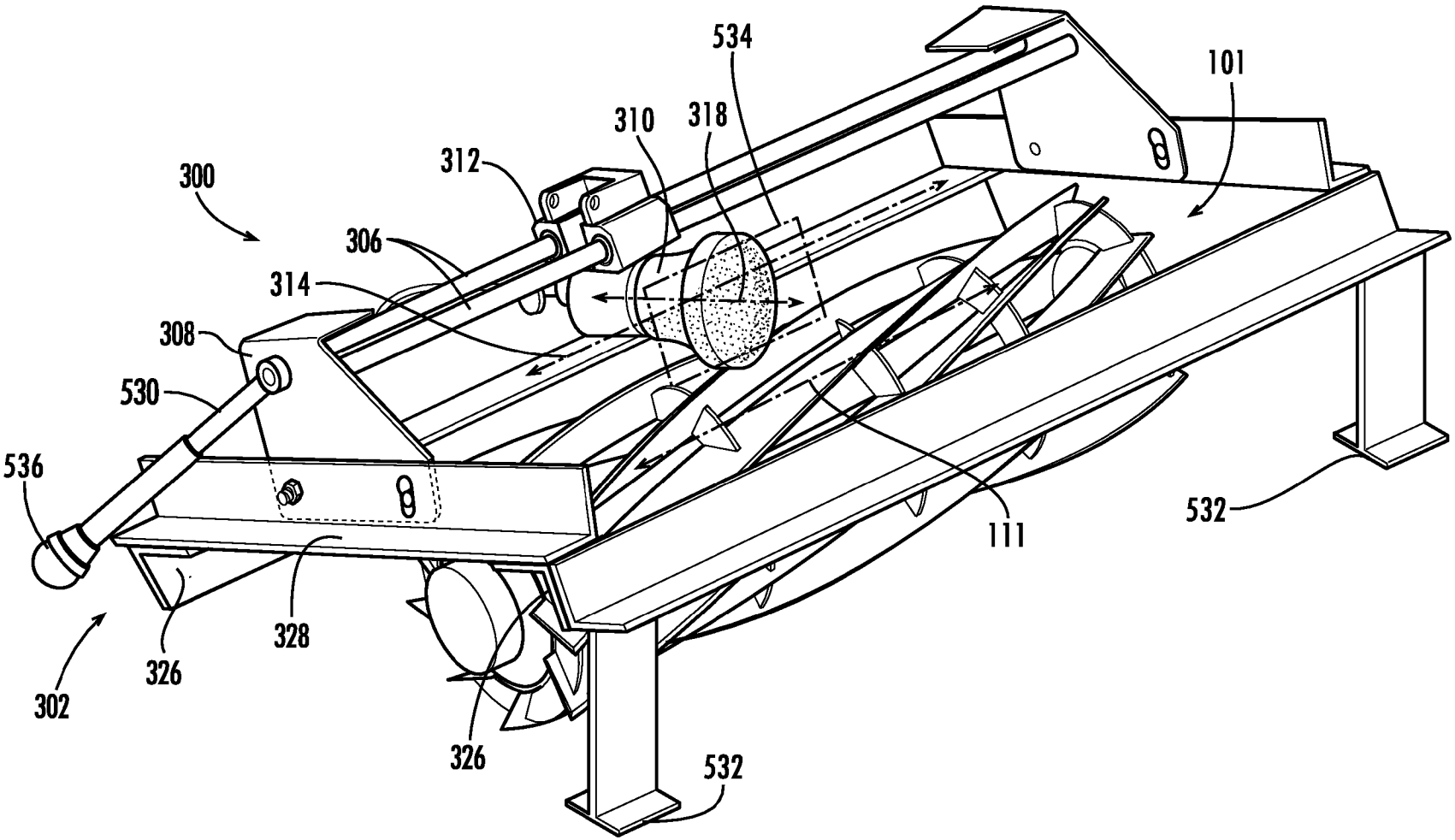
FIG. 5 is a perspective view of the lawnmower blade sharpener of FIG. 3 coupled to a plurality of feet, illustrating a reel positioned below the lawnmower blade sharpener.

The grinding wheel 310 is a substantially solid body that can be made from a wide range of grit types having a variety of grit sizes, depending on the characteristics of the reel blades 103 to be sharpened. As illustrated, the grinding wheel 310 has a curved or concave outer surface 338 that is used for sharpening the reel blades 103. However, the outer surface 338 of the grinding wheel 310 need not be curved or concave. For example, the outer surface 338 may be the surface of a cylinder, such as a right cylinder, the surface of a cone, the surface of a tapered or concave cone, or the surface of a bell shape. In some cases, the grinding wheel 310 is initially a cylinder, and the outer surface 338 is the surface of the cylinder. As the grinding wheel 310 wears, it wears unevenly such that the outer surface 338 becomes tapered, concave, or bell shaped. The tapered or bell shaped outer surface 338 may be shaped to contact multiple reel blades simultaneously. Compared to the reel 101, the grinding wheel 310 is relatively smaller than the reel 101, a diameter of the grinding wheel 310 being relatively smaller than a longitudinal length of the reel 101, and a height of the grinding wheel 310 being relatively smaller than a diameter of the reel 101 (FIG. 5).

The grinding wheel 310 has an axis of rotation 318 extending through its center, and is oriented on the carriage 312 so that the axis of rotation 318 is generally transverse to, and may be perpendicular to, the path of linear translation 314 of the grinding wheel 310. For the purposes of this disclosure, the term "transverse" means lying or extending across or in a cross direction, forming an angle that is greater than forty-five degrees with a line or direction, and/or generally being oriented closer to a perpendicular direction than to a parallel direction with reference to a line or direction. In the case of the axis of rotation 318 of the grinding wheel 310, while the axis of rotation 318 may be substantially perpendicular to the path of linear translation 314, such an orientation is not required. Instead, the axis of rotation 318 may be transverse to the path of linear translation 314, so that the axis of rotation 318 forms an angle from forty-five degrees up to ninety degrees with the path of linear translation 314.

In the illustrated embodiment, the grinding wheel 310 is oriented on the carriage 312 so that its axis of rotation 318 is substantially perpendicular to its path of linear translation 314. In some embodiments, the grinding wheel 310 is mounted on a spindle that aligns with the axis of rotation 318, such that rotation of the spindle causes associated rotation of the grinding wheel 310, although other configurations are possible.

As shown in FIG. 4, a powering device 320 configured to rotate the grinding wheel 310 is coupled to the grinding wheel 310, and a supply line 322 is coupled to the powering device 320. As shown, the powering device 320 is a pneumatic motor, and the supply line 322 is an air supply line that supplies the pneumatic motor with compressed air from an air compressor 324 (FIG. 3). The pneumatic motor is mounted to the underside of the carriage 312 using a fastener such as a bracket, but can be coupled to the carriage 312 in other positions. The pneumatic motor rotates the spindle, which causes the grinding wheel 310 mounted on the spindle to rotate. In some cases, the grinding wheel 310 rotates at a rate of about 2000 revolutions per minute, although other speeds are possible. Therefore, the pneumatic motor is a means for rotating the grinding wheel 310 about its axis of rotation 318, although other such means can be employed to rotate the grinding wheel 310.

For example, the powering device 320 may be an electric motor and the supply line may be an electrical cord that supplies the electric motor with electricity. Additionally, the powering device 320 may be a hydraulic motor and the supply line may supply the hydraulic motor with pressurized hydraulic fluid, or the powering device 320 may be a battery powered motor in which case the supply line 322 may be omitted. Further, the spindle may be omitted, in which case the powering device 320 may be coupled directly to the grinding wheel 310, or to a base plate positioned on an underside of the grinding wheel 310. Still other means for rotating the grinding wheel 310 about its axis of rotation can be employed and are intended to be included within the scope of the present disclosure. Such means may be known now, or may later become apparent to a person of ordinary skill in the art.

With reference to FIGS. 3 and 4, the supporting frame 302 includes longitudinal frame members 326 and transverse frame members 328. The frame members are arranged to form a closed rectangular shape and are fastened together using fasteners such as bolts. So that the reel 101 can be placed between the transverse frame members 328, the transverse frame members 328 are spaced apart by a distance that is at least the length of the reel 101. The supports 308 extend upward from the transverse frame members 328, and the railway 306 extends between the supports 308.

FIG. 5 is a perspective view of the lawnmower blade sharpener 300 coupled to a plurality of feet, illustrating the reel 101 positioned for sharpening below the sharpener 300. The reel 101 is oriented so that its longitudinal axis 111 generally extends in the direction of the railway 306. Therefore, the axis of rotation 318 of the grinding wheel 310 is transverse to the longitudinal axis 111 of the reel 101. In some cases, the reel 101 is aligned with the railway 306, the longitudinal axis 111 of the reel 101 being substantially parallel to the path of linear translation 314 of the grinding wheel 310 to define a plane 534. In such cases, the axis of rotation 318 of the grinding wheel 310 may be substantially perpendicular to that plane 534 so that the grinding wheel 310 rotates in the plane 534, as shown in FIG. 5.

The feet elevate the sharpener 300 so that the reel 101 can be positioned below the supporting frame 302, and at least some of the feet are adjustable so that the elevation can be varied. As shown, the supporting frame 302 is positioned on two adjustable feet 530 and two fixed feet 532, each of the two adjustable feet 530 having an adjustment knob 536 that can be rotated to vary the length of the adjustable foot 530. The feet 530, 532 maintain the spacing between the supporting frame 302 and the reel 101, for reasons described below.

To sharpen the reel blade 103, the grinding wheel 310 contacts the reel 101. More specifically, the outer surface 338 of the grinding wheel 310 tangentially contacts the cutting surface 107 of at least one reel blade 103. The axis of rotation 318 of the grinding wheel 310 is generally transverse to the cutting edge 105 of the reel blade 103, and may be substantially perpendicular to the cutting edge 105. Additionally, the axis of rotation 318 of the grinding wheel 310 is parallel to the cutting surface 107. If necessary, the elevation of the supporting frame 302 can be adjusted to vary the position of the grinding wheel 310, such as by rotating the adjustment knobs 534 on the adjustable feet 530.

The grinding wheel 310 is rotated about its axis of rotation 318 by the powering device 320, so that the outer surface 338 of the grinding wheel 310 sharpens the cutting edge 105 and levels the cutting surface 107. The carriage 312 slides along the railway 306 to move the grinding wheel 310 along the path of linear translation 314, repositioning the grinding wheel 310 to sharpen cutting edges 105 and level cutting surfaces 107 located along the path of linear translation 314. The reel 101 rotates about its longitudinal axis 111 to expose all of the reel blades 103 to the grinding wheel 310. In this manner, the entire reel 101 is sharpened.

More specifically, rotating the grinding wheel 310 sharpens only a discrete portion of the reel in contract with the grinding wheel 310. The discrete portion includes a portion of the cutting surface 107 of at least one reel blade 103, although multiple reel blades 103 may be included depending on the spacing of the reel blades 103 and the shape of the grinding wheel 310. For example, the bell shape of the grinding wheel 310 in FIG. 5 enables sharpening portions of multiple reel blades 103 simultaneously.

In some cases, the reel blades 103 spiral about the reel 101 as shown in FIG. 1. In such cases, moving the grinding wheel 310 along its path of linear translation 314 sharpens a longitudinal section of the reel 101 as opposed to sharpening an individual reel blade 103. The longitudinal section is substantially the width of the grinding wheel 310 and extends along the path of linear translation 314. To sharpen longitudinal sections that are circumferentially spaced about the reel 101, the reel 101 is rotated about its longitudinal axis 111. In some embodiments, one longitudinal section is completely sharpened before the reel 101 is rotated. In other embodiments, the reel 101 is continuously rotated as the grinding wheel 310 continuously traverses its path of linear translation 314, until the entire reel 101 is sharpened.

As the reel 101 is rotated, the sharpener 300 maintains the spacing between the longitudinal axis 111 of the reel 101 and the outer surface 338 of the grinding wheel 310. In other words, a distance from the longitudinal axis 111 of the reel 101 to the cutting surface 107 of the reel blade 103 is relatively the same at different points along the longitudinal length of a single reel blade 103, and from reel blade 103 to reel blade 103. Maintaining the spacing ensures the reel blades 103 are uniformly leveled, so that the reel maintains its cylindrical shape to cut grass at a relatively uniform height.

As shown, the powering device 320 rotates the grinding wheel 310, the carriage 312 is manually moved along the railway 306, such as by grasping the carriage 312 and sliding the carriage 312 along the railway 306, and the reel 101 is manually rotated about its longitudinal axis 111, such as by grasping the reel 101 and rotating it. In other embodiments, the sharpener includes means for automating the movement of the grinding wheel 310 along the path of linear translation 314, and means for automating the rotation of the reel 101 about its longitudinal axis 111.

Figure 6:
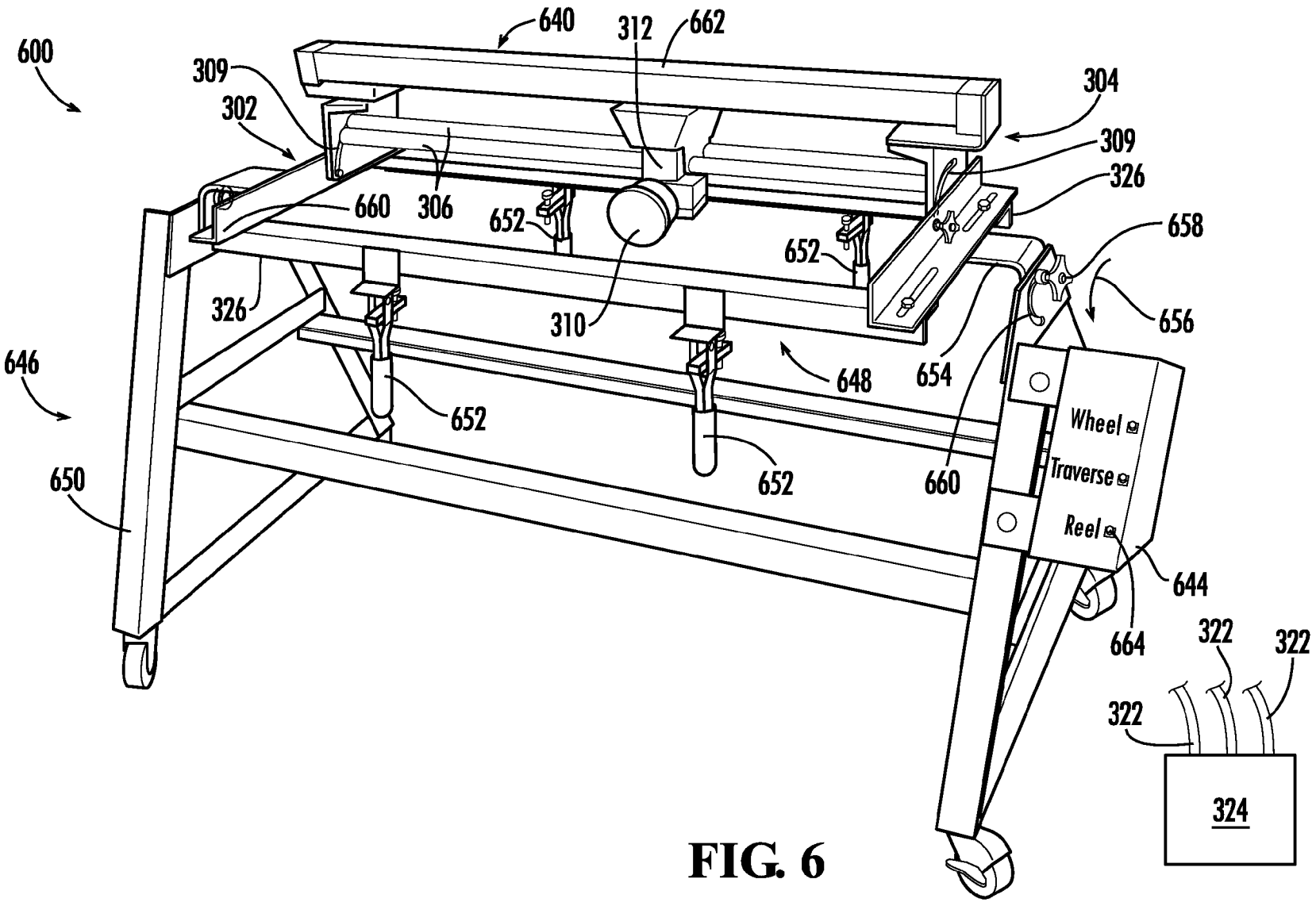
FIG. 6 is a perspective view of another embodiment of a lawnmower blade sharpener of the present disclosure.

Such an embodiment is shown in FIG. 6, which is a perspective view of another embodiment of a lawnmower blade sharpener 600. The sharpener 600 generally includes the supporting frame 302 and carriage assembly 304 as shown in FIGS. 3 and 4. In addition, the sharpener includes means for automating the movement of the grinding wheel 310 along the path of linear translation 314, means for automating the rotation of the reel 101 about its longitudinal axis 111, a control box 644, an elevating mechanism 646 that elevates the supporting frame 302, and a means for holding the reel in the sharpener 600.

The elevating mechanism 646 elevates the sharpener 600 to a working height. As shown, the elevating mechanism 646 includes a plurality of elevating legs 650, such as A-shaped legs, that are braced by a plurality of cross beams extending horizontally between the elevating legs 650. Casters positioned on lower ends of the elevating legs 650 enable moving the sharpener 600 with relative ease. In other embodiments, the elevating mechanism 646 may have other shapes and configurations, or may be omitted.

The means for holding the reel 101 in the sharpener 600 couples the reel 101 to the sharpener 600. In the illustrated embodiment, a securing mechanism 648, such as a plurality of clamps 652 coupled to the longitudinal frame members 326 of the supporting frame 302, couples the reel 101 to the sharpener 600. In other cases, the means for holding the reel 101 can have any other configuration that is known, or will become known, to a person of skill in the art. Further, the entire reel unit may be coupled to the sharpener 600, so that the reel 101 can be sharpened without disassembling the reel unit, as shown. In some cases, the means for holding the reel maintains the alignment and spacing of the reel 101 with respect to the grinding wheel 310. As described above, maintaining the alignment and spacing may be desirable, so that each of the reel blades 103 is uniformly leveled during sharpening, and the reel 101 maintains its cylindrical shape.

The reel unit is placed in the sharpener 600 from below, so that the reel blades 103 are exposed to the grinding wheel 310. Because it may be relatively cumbersome to attach the reel unit to the supporting frame 302 from below, the supporting frame 302 is pivotally coupled to the elevating mechanism 646 using a pivot mechanism 654. The pivot mechanism 654 enables rotating the supporting frame 302 in a direction of rotation 656, so that the reel unit can be placed in the sharpener 600 from above. In the illustrated embodiment, the pivot mechanism 656 is a curved slot 660 formed through each of the elevating legs 650, and a tightening device 658 positioned in each of the slots 660. The tightening device 658 may be a knob on a threaded shaft extending through the slot 660, as shown. To attach the reel unit to the sharpener 600, the tightening device 658 is loosened. The supporting frame 302 is rotated in a direction of rotation 656, causing the threaded shaft to traverse the curve of the slot 660. When the end of the slot 660 is reached, the supporting frame 302 is oriented so that the carriage 312 and grinding wheel 310 are positioned below the supporting frame 302 and the securing mechanism 648 is reachable above the supporting frame 302. The reel unit is placed on the supporting frame 302 and is clamped to the supporting frame using the securing mechanism 648. The supporting frame 302 is then rotated back into its operating position, and the tightening device 658 is tightened to maintain the supporting frame 302 in place. The reel blades 103 on the reel 101 are then exposed to the grinding wheel 310 for sharpening.

As shown, the sharpener 600 includes means for automating the movement of the grinding wheel 310 along the path of linear translation 314, such as a powering device 640 configured to linearly translate the grinding wheel 310 along its path of linear translation 314. In the illustrated embodiment, an overhead track 662 extends above the railway 306, and the carriage 312 is slidably mounted to the overhead track 662. More specifically, the carriage 312 is slidably coupled to the overhead track 662 from above, and is slidably coupled to the railway 306 from below, such that movement of the carriage 312 along the overhead track 662 simultaneously moves the carriage 312 along the railway 306. The powering device 640 is coupled to the overhead track 662, moving the carriage 312 so that the grinding wheel 310 traverses its path of linear translation 314.

The sharpener 600 also includes means for automating the rotation of the reel 101 about its longitudinal axis, such as a powering device 642 configured to rotate the reel 101 about its longitudinal axis 111. The powering device 642 has an axis that extends into an opening in the reel 101 to rotate the reel.

The reel 101 is rotated at a relatively slow rotational velocity to reduce the impact and vibration between the reel 101 and the grinding wheel 310, as described below. In some embodiments, the powering device 642 rotates the reel 101 at rotational speed of about one to two revolutions per minute, although other configurations are possible.

The powering devices 640, 642 can have any of the configurations described above with reference to the powering device 320 that rotates the grinding wheel 310. For example, the powering devices 640, 642 can be pneumatic motors having air supply lines coupled to one or more air compressors, or sharing the air compressor 324 with the powering device 320, as shown. Note that the air compressor is shown disconnected from the powering devices 320, 640, 642 for simplicities sake. In some cases, the powering device 640 may be omitted completely, in which case the carriage 312 is manually moved along the railway 306, or the powering device 642 may also be omitted completely, in which case the reel 101 is manually rotated.

The sharpener 600 also includes a control box 644 configured to control one or more of the powering devices 320, 640, 642. As shown, the control box 644 includes one or more switches 664, each switch being movable between an on and off position. In the illustrated embodiment, each powering device 320, 640, 642 has its own switch 664. For example, the switch 664 may be coupled to the supply line 322 of the powering device 320, so that flow through the supply line 322 is allowed when the switch 664 is in the on position and is interrupted when the switch 664 is in the off position. In such an embodiment, each of the rotation of the grinding wheel 310, the traversal of the grinding wheel 310, and the rotation of the reel 101 may be separately controlled. In other cases, one switch 664 may control a single source that feeds each of the powering devices, such as the air compressor 324, so that all of the powering devices are turned on and off by one switch 664.

In some cases, the sharpener 600 includes a guard (not shown). The guard substantially covers the grinding wheel 310 as it traverses its path of linear translation 314, so that the grinding wheel 310 is shielded from the user during the sharpening process.

The embodiments of the lawnmower blade sharpener described above are configured such that during sharpening, the impact between the grinding wheel and the reel is relatively low, because the grinding wheel is oriented with its axis of rotation transverse to the cutting edges of the reel blade, and the reel is rotated relatively slowly or not at all. The low impact contact between the grinding wheel and the reel reduces the vibrations created during sharpening. Therefore, the sharpener does not require bulky or heavy anti-vibration equipment or dampening equipment to operate effectively, which enables creating a sharpener that is relatively lightweight and portable. Additionally, the sharpener does not need to be manufactured from bulky or robust materials to withstand the impact and vibration, which enables manufacturing the sharpener from relatively lightweight materials such as aluminum. In cases in which the powering devices are pneumatic motors, the sharpener can be controlled without the use of electricity, electric switches, sensors, circuit boards, fuses, or wiring connections, which increases the portability of the sharpener and reduces the number of parts that can malfunction. The low impact between the grinding wheel and the reel also enables sharpening the reel in the reel unit without unduly stressing components of the reel unit, such as the reel bearings, seals, shaft, and frame. Therefore, the reel can be sharpened without dissembling the reel unit, the entire reel unit being secured in the sharpener with the rollers and bed knife intact. The lawnmower blade sharpener sharpens most greens, tees, light weight fairway and walk behind professional mowers.

In some embodiments, the sharpener is configurable so that in addition to sharpening the reel blades 103 of a reel 101, the sharpener can be employed to perform other types of sharpening, such as relief grinding, bed knife sharpening, or rotary blade sharpening. To perform these additional sharpening functions, one or more of the following configurations may occur: the grinding wheel may be changed, the grinding wheel may be pivoted on the carriage, and/or the carriage assembly may be pivoted in the supporting frame, as described below.

Figure 2:
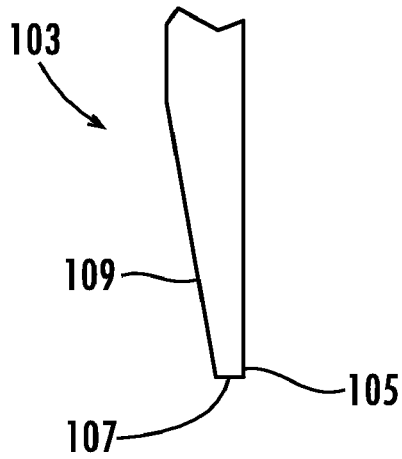
FIG. 2 (PRIOR ART)
FIG. 2 is a partial side elevational view of a reel blade of the prior art, illustrating a cutting edge, a cutting surface, and a relief angle of the reel blade.

For relief grinding, the grinding wheel 310 pivots with respect to the carriage 312 between a sharpening position, in which the axis of rotation 318 of the grinding wheel 310 is transverse to its path of linear translation 314, as described above, and a relief grinding position, in which the axis of rotation 318 of the grinding wheel 310 is parallel to its path of linear translation 314. In the grinding position, the grinding wheel 310 can grind the angled relief surface 109 on a back side of the reel blade 103 opposite from the cutting edge 105, shown in FIG. 2. More specifically, the outer surface 338 of the grinding wheel 310 tangentially contacts the angled relief surface 109, the axis of rotation 318 of the grinding wheel 310 being generally parallel to the angled relief surface 109. As the grinding wheel 310 rotates, the interaction between the outer surface 338 of the grinding wheel 310 and the angled relief surface 109 grinds the angled relief surface 109. Because the reel blades 103 are usually twisted with respect to the longitudinal axis 111 of the reel 101, the grinding wheel 310 is kept in contact with the angled relief surface 109 by manually moving the grinding wheel 310 along the path of linear translation 314 while manually rotating the reel 101 about its longitudinal axis 111. Additionally, the grinding wheel 310 may be relatively shorter along the axis of rotation 314 than in reel sharpening applications.

Figure 7:
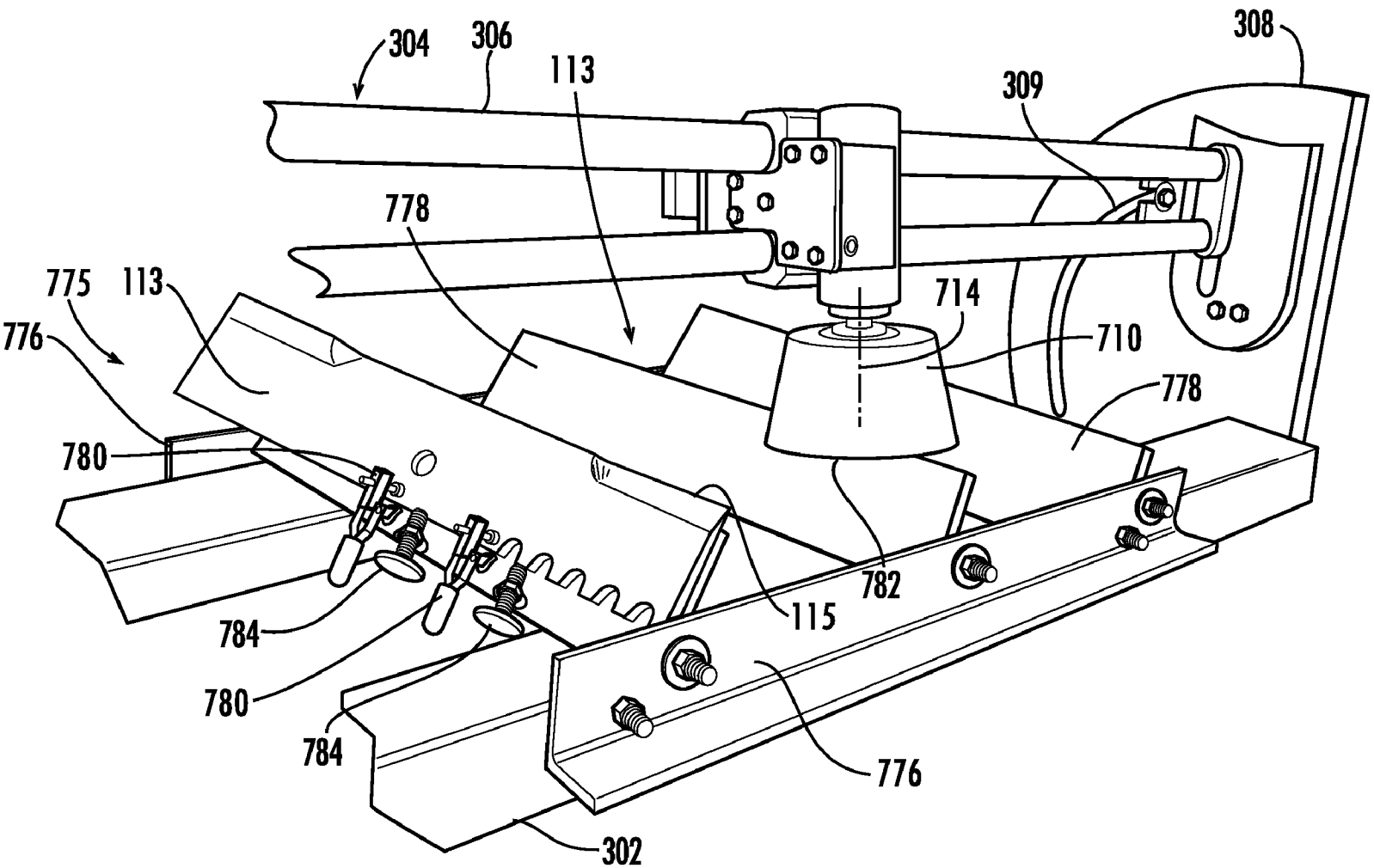
FIG. 7 is a perspective view of an embodiment of a rotary blade attachment that can be attached to an embodiment of the lawnmower blade sharpener to sharpen rotary lawnmower blades, the attachment being illustrated with the lawnmower blade sharpener shown in FIG. 6.

For bed knife and rotary blade sharpening, the grinding wheel is changed. As mentioned above, the grinding wheel 310 has a substantially solid body, but for bed knife and rotary blade sharpening, a cupped grinding wheel 710 is used. The cupped grinding wheel 710 has a hollow interior, and the grinding surface of the grinding wheel is a lip 782 formed on an edge of the cupped grinding wheel 710, as shown in FIG. 7.

In addition to changing the grinding wheel, the entire carriage assembly 304 pivots for bed knife and rotary blade sharpening. As shown in FIGS. 6 and 7, each of the supports 308 includes a curved slot 309, and the carriage assembly 304 is pivotally coupled to the curved slot 309. Pivoting the carriage assembly 304 adjusts the position of the railway 306, and therefore the grinding wheel, with respect to the supporting frame 302. The curved slot 309 covers a relatively large angular range, so that the grinding wheel can be pivoted between a first position in which the axis of rotation of the grinding wheel is substantially parallel to the supporting frame 302, as shown in FIG. 6, and a second position in which the axis of rotation of the grinding wheel is substantially perpendicular to the supporting frame 302, as shown in FIG. 7.

For reel sharpening, the grinding wheel 310 is used in the first position, as described above. For bed knife sharpening, the grinding wheel 710 is used in both the first and second positions, as described below. For rotary blade sharpening, the grinding wheel 710 is used in the second position, as described below.

To sharpen a bed knife (not shown), the bed knife is removed from the reel unit and is secured to the supporting frame 302. The longitudinal length of the bed knife extends in the general direction of the railway 306. The grinding wheel 710 is attached to the sharpener, and is placed in the first position with the lip 782 of the grinding wheel 710 contacting the front edge of the bed knife (not shown). The axis of rotation 714 of the grinding wheel 710 is perpendicular to the front edge of the bed knife and is parallel to the surface of the bed knife. As the grinding wheel 710 rotates and linearly translates, the front edge of the bed knife is sharpened. The grinding wheel 710 is then placed in the second position, with the lip 782 of the grinding wheel 710 contacting a top face of the bed knife. The axis of rotation 714 of the grinding wheel 310 is perpendicular to the surface of the bed knife, and is perpendicular to the front edge of the bed knife. As the grinding wheel 710 rotates and linearly translates, the top surface of the bed knife is sharpened.

FIG. 7 is a perspective view of an embodiment of a rotary blade attachment 775 that can be attached to an embodiment of the lawnmower blade sharpener to sharpen rotary lawnmower blades, the attachment 775 being illustrated in use with the lawnmower blade sharpener 600 shown in FIG. 6. Unlike the reel lawnmower, a rotary lawnmower employs a planar rotary blade 113. The rotary lawnmower rotates the rotary blade 113 about an axis that is substantially perpendicular to the cutting surface, so that the rotary blade 113 rotates in a plane that is substantially parallel to the cutting surface. As shown in FIG. 7, the rotary blade 113 is sharpened on two opposed cutting surfaces 115. Each of the cutting surfaces 115 is angled with respect to the surface of the rotary blade and extends longitudinally inward from a distal tip of the rotary blade 113, as shown. In some embodiments, each cutting surface 115 is about four inches long.

The attachment 775 generally includes two frame members 776 that are spaced apart from each other, and one or more adjustable mounting plates 778 that are pivotally coupled to the frame members 776. In the illustrated embodiment, each mounting plate 778 is positioned on an axle that extends through the frame members 776 and is held in position by a bolt, although other configurations are possible. The rotary blade 113 is coupled to the mounting plate 778 using one or more clamping mechanisms 780. As shown, the clamping mechanisms 780 are hold-down clamps. The rotary blade 113 is leveled using one or more adjusters 784. As shown, the adjusters 784 are threaded screws positioned in nuts coupled to the mounting plates 778.

To sharpen one or more rotary blades 113, the rotary blade attachment 775 is positioned in the sharpener 600 with the mounting plates 778 generally perpendicular to the path of linear translation 314 of the grinding wheel 710. The rotary blade 113 is coupled to the mounting plate 778 using the clamping mechanisms 780. The angular position of the mounting plate 778 is adjusted by loosening the bolts, rotating the mounting plate 778 about the axle, and tightening the bolt. The rotary blade 113 is leveled using the adjusters 784. As shown, a lower edge of the rotary blade 113 rests on an upper surface of the threaded screw, and rotating the threaded screw in the nut raises the threaded screw, and therefore the rotary blade 113. Prior to sharpening, the cupped grinding wheel 710 is coupled to the sharpener 600. The cupped grinding wheel 710 is placed in the second position, in which the axis of rotation 714 of the cupped grinding wheel 710 is wheel is perpendicular to the cutting surface 115. The cupped grinding wheel 710 rotates about it axis of rotation, and traverses the path of linear translation 314 to sharpen the cutting surface 115. In cases in which a diameter of the grinding wheel 710 is substantially the same as a length of the cutting surface 115 of the rotary blade 113, the entire cutting surface 115 can be sharpened by moving the grinding wheel 710 along the path of linear translation 314 as the grinding wheel 710 rotates. In embodiments in which rotary blades 113 are coupled to multiple different mounting plates 778, multiple rotary blades 113 can be sharpened simultaneously during the traversal.

Figure 8:
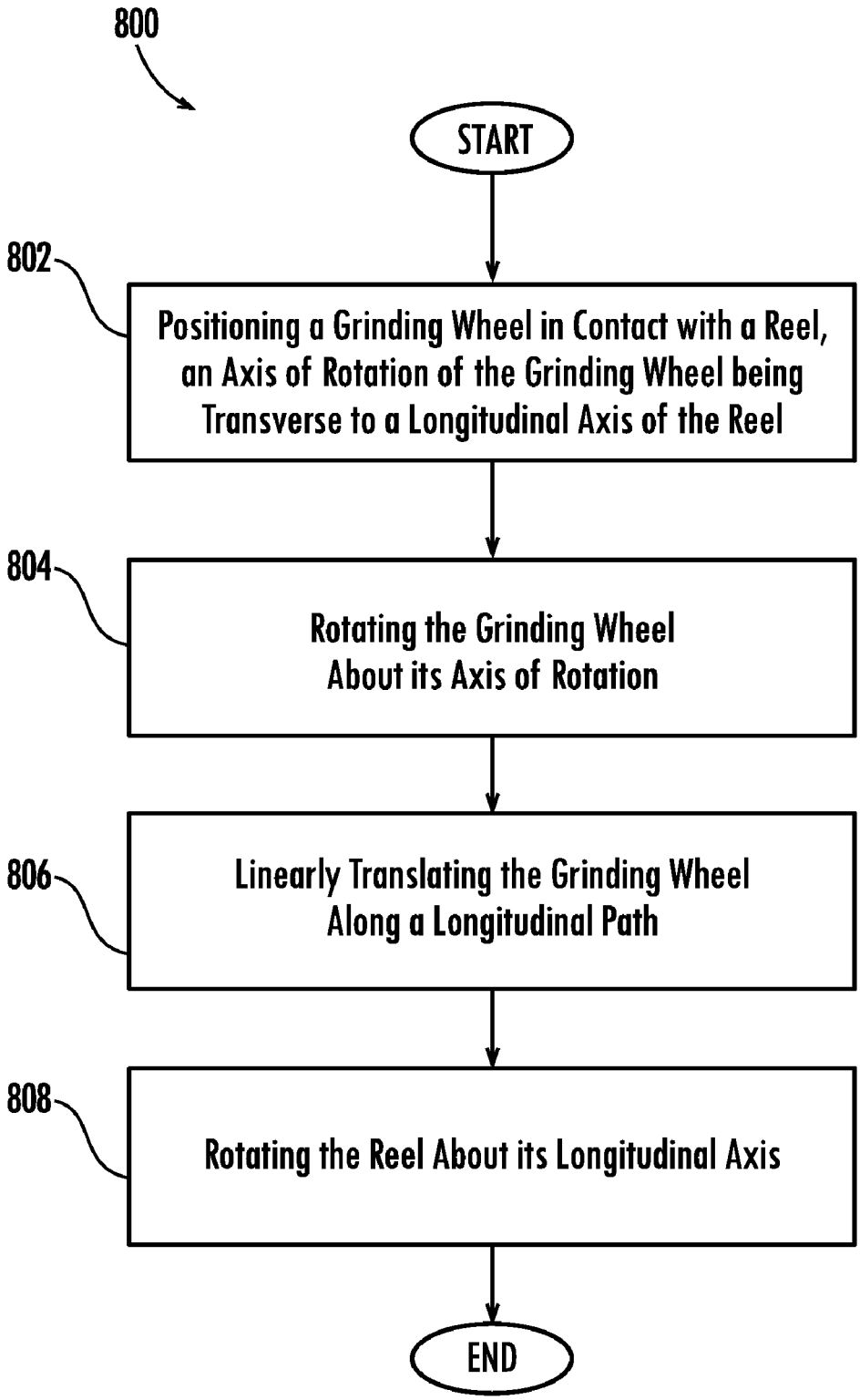
FIG. 8 is a block diagram illustrating an embodiment of a method of sharpening a reel of a reel lawnmower.

FIG. 8 is an embodiment of a method 800 of sharpening a reel of a reel lawnmower. In block 802, a grinding wheel is positioned in contact with a reel, the grinding wheel being positioned so that its axis of rotation is generally transverse to, and may be substantially perpendicular to, a longitudinal axis of the reel. The grinding wheel tangentially contacts a discrete portion of the reel. The contacted discrete portion includes a portion of a cutting edge and a cutting surface of at least one reel blade, although portions of multiple reel blades may be contacted depending on the size of the grinding wheel and the spacing of the reel blades. With respect to the contacted portion of the reel blade, the grinding wheel is positioned so that its axis of rotation is generally transverse to the cutting edge, and may be perpendicular to the cutting edge. The grinding wheel is also positioned so that its axis of rotation is substantially parallel to the cutting surface. An outer surface of the grinding wheel tangentially contacts the cutting surface.

In block 804, the grinding wheel is rotated about its axis of rotation. Rotating the grinding wheel sharpens the contacted discrete portion of the reel. The outer surface of the grinding wheel moves tangentially along the surface of the contacted discrete portion, in a direction that is generally parallel to the cutting edge. This interaction between the outer surface of the grinding wheel and the contacted discrete portion sharpens the cutting edges and levels the cutting surfaces located within the discrete portion. In some cases, the grinding wheel is automatically rotated, such as by a powering device. For example, the grinding wheel may be rotated relatively quickly, such as at a rate of about 2000 revolutions per minute.

In block 806, the grinding wheel is linearly translated along a longitudinal path. The longitudinal path generally extends in the direction of the longitudinal axis of the reel, and may be substantially parallel to the longitudinal axis of the reel. The grinding wheel may be manually linearly translated or automatically linearly translated by, for example, a powering device. In embodiments in which the longitudinal path traversed by the grinding wheel in block 806 is parallel to the longitudinal axis of the reel, a plane is defined by the longitudinal path of the grinding wheel and the longitudinal axis of the reel. In such cases, in block 802 the grinding wheel may be positioned with its axis of rotation perpendicular to that plane, and in block 804 the grinding wheel may be rotated in that plane. In most cases, the grinding wheel rotates about its axis of rotation in block 804 while simultaneously linearly traversing the longitudinal path in block 806, so that the grinding wheel sharpens a longitudinal section of the reel. The longitudinal section includes the discrete portions of the reel located along the longitudinal path, and may include portions of the cutting edges and cutting surfaces of multiple different reel blades, such as in cases in which the reel blades spiral around or form a chevron pattern on the reel. In some cases, linearly translating the grinding wheel along the longitudinal path in block 806 further comprises linearly translating the grinding wheel while maintaining the distance from the longitudinal axis of the reel to the outer surface of the grinding wheel. Maintaining this spacing facilitates relatively uniform leveling of the cutting surfaces.

In block 808, the reel rotates about its longitudinal axis to expose a different longitudinal section of the reel to the grinding wheel. To reduce the impact and vibration between the grinding wheel and the reel, the reel is rotated at a relatively slow rotational velocity, such as about one to two revolutions per minute. The reel can be manually rotated, or automatically rotating by, for example, a powering device. In some cases each longitudinal section of the reel is sharpened by simultaneously rotating the grinding wheel about its axis of rotation in block 804 while linearly translating the grinding wheel along the longitudinal path in block 806, and once the longitudinal section is sharpened, the reel is rotated in block 808 to expose a different longitudinal section to the grinding wheel. This pattern is repeated until each longitudinal section of the reel is sharpened. In other cases, the grinding wheel is rotated and linearly translated in blocks 804 and 806 as the reel is rotated in block 808. In such cases, with continued rotation and linear translation the entire reel is sharpened. In some cases, rotating the reel in block 808 further comprises rotating the reel while maintaining the distance from the longitudinal axis of the reel to the outer surface of the grinding wheel to facilitate relatively uniform leveling of the cutting surfaces.

Figure 9:
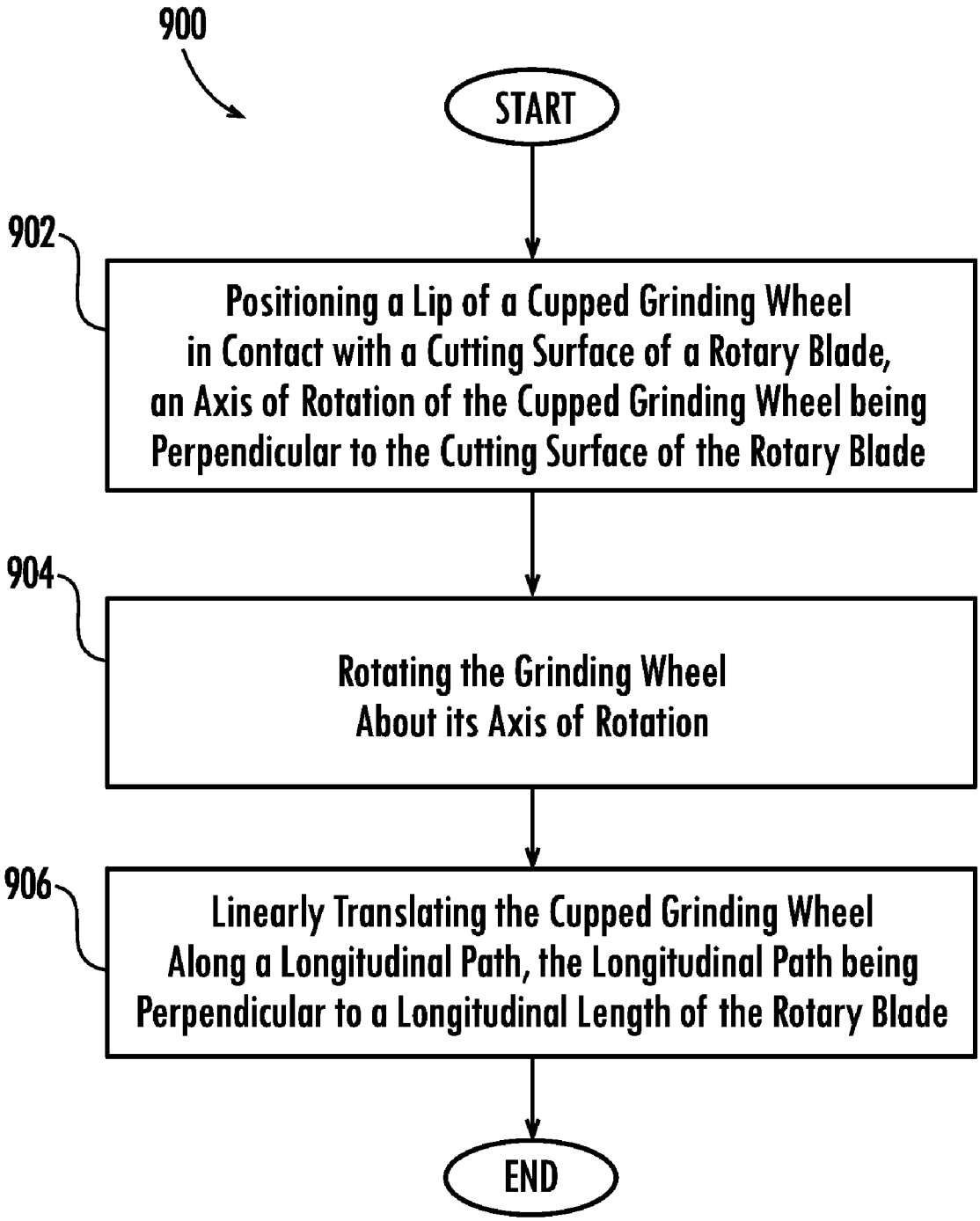
FIG. 9 is a block diagram illustrating an embodiment of a method of sharpening a rotary blade of a rotary lawnmower.

FIG. 9 is an embodiment of a method 900 of sharpening a rotary blade of a rotary lawnmower. In block 902, a lip of a cupped grinding wheel is positioned in contact with a cutting surface of a rotary blade, the cupped grinding wheel being positioned so that its axis of rotation is generally perpendicular to the cutting surface of the blade. In block 904, the grinding wheel is rotated about its axis of rotation. In block 906, the grinding wheel is linearly traversed along a longitudinal path, the longitudinal path being substantially perpendicular to a longitudinal length of the rotary blade. In some embodiments, the steps of rotating the grinding wheel about its axis of rotation in block 904 and linearly traversing the grinding wheel along the longitudinal path in block 906 occur simultaneously.

In some embodiments, the method 900 further comprises positioning a plurality of rotary blades substantially parallel to each other, the rotary blades being spaced apart from each other, the longitudinal length of each rotary blade being generally perpendicular to the longitudinal path of the cupped grinding wheel, and the cutting surface of each blade being generally perpendicular to the axis of rotation of the cupped grinding wheel. In such embodiments, linearly traversing the cupped grinding wheel along the longitudinal path in block 906 sharpens one or more of the rotary blades, and may sharpen each of the rotary blades. In still other embodiments, the method 900 further comprises attaching a cupped grinding wheel to the axis of rotation, a diameter of the cupped grinding wheel being substantially the same as a length of the cutting surface of the rotary blade. In such embodiments, linearly traversing the cupped grinding wheel along the longitudinal path in block 906 as the grinding wheel rotates about its axis of rotation in block 904 sharpens the cutting surface along its entire longitudinal length.

While particular embodiments of a lawnmower blade sharpener have been disclosed in detail in the foregoing description and drawings for purposes of example, those skilled in the art will understand that variations and modifications may be made without departing from the scope of the disclosure. All such variations and modifications are intended to be included within the scope of the present disclosure, as protected by the following claims.

The invention claimed is:

1. A method of sharpening a reel blade on a lawnmower reel, the method comprising:

positioning a grinding wheel in contact with the reel blade so that an axis of rotation of the grinding wheel is transverse to a longitudinal axis of the reel;

rotating the grinding wheel about its axis of rotation;

linearly translating the grinding wheel along a longitudinal path; and rotating the reel about its longitudinal axis;

wherein positioning the grinding wheel in contact with the reel blade comprises:

positioning the grinding wheel so that the axis of rotation of the grinding wheel is transverse to a cutting edge of the reel blade, and rotation of the grinding wheel is along a cutting surface of the reel blade, tangentially contacting the cutting surface of the reel blade with an outer surface of the grinding wheel, and wherein the reel blade has a relief surface on one side of the reel blade and a cutting surface having a cutting edge on a distal end of the reel blade, and the step of positioning the grinding wheel includes positioning the grinding wheel so that the axis of rotation of the grinding wheel is transverse to the cutting edge on the distal end of the reel blade.

2. The method of claim 1, wherein positioning the grinding wheel in contact with the reel blade comprises positioning the grinding wheel so that the axis of rotation of the grinding wheel is perpendicular to the longitudinal axis of the reel.

3. The method of claim 1, wherein rotating the grinding wheel about its axis of rotation comprises moving an outer surface of the grinding wheel tangentially along a cutting surface of the reel blade in a direction that is generally parallel to a cutting edge of the reel blade, so that the grinding wheel sharpens the cutting edge and levels the cutting surface.

4. The method of claim 1, wherein linearly translating the grinding wheel along a longitudinal path comprises linearly translating the grinding wheel in a direction that is parallel to the longitudinal axis of the reel.

5. The method of claim 1, wherein rotating the reel about its longitudinal axis comprises rotating the reel about one to two revolutions per minute.

6. The method of claim 1, wherein the grinding wheel is simultaneously rotated about its axis of rotation and linearly translated along the longitudinal path.

7. The method of claim 1, wherein rotating the reel about its longitudinal axis comprises rotating the reel while maintaining a distance between the longitudinal axis of the reel and an outer surface of the grinding wheel, so that relatively uniform leveling of the reel blades is facilitated.

8. The method of claim 1, wherein:

a plane is defined by the path of linear translation of the grinding wheel and the longitudinal axis of the reel; and the axis of rotation of the grinding wheel is perpendicular to the plane.

9. A method of sharpening a rotary lawnmower blade comprising:

providing a grinding wheel having an axis of rotation and a curved outer surface;

positioning a portion of the curved outer surface of the grinding wheel in contact with a cutting surface of a rotary blade, the axis of rotation of the grinding wheel being transverse to the cutting surface of the rotary blade; and rotating the grinding wheel about its axis of rotation, wherein the rotary blade has a relief surface on one side of the rotary blade and a cutting surface having a cutting edge on a distal end of the reel blade, and the step of positioning the grinding wheel includes positioning the grinding wheel so that the axis of rotation of the grinding wheel is transverse to the cutting edge on the distal end of the rotary blade.

10. The method of claim 9, wherein rotating the grinding wheel about its axis of rotation comprises moving the outer surface of the grinding wheel tangentially along a cutting surface of the reel blade in a direction that is generally parallel to a cutting edge of the reel blade, so that the grinding wheel sharpens the cutting edge and restores the cutting surface.

11. The method of claim 1, wherein the outer surface of the grinding wheel contacting the cutting surface of the reel blade is a curved grinding surface.

12. The method of claim 1, wherein the reel blade has a relief surface on one side of the reel blade and a cutting surface on a distal end of the reel blade, and the step of positioning the grinding wheel includes positioning the grinding wheel so that the axis of rotation of the grinding wheel is transverse to the cutting surface on the distal end of the reel blade.

13. A method of sharpening a reel blade on a lawnmower reel, the method comprising:

positioning a grinding wheel in contact with the reel blade so that an axis of rotation of the grinding wheel is transverse to a longitudinal axis of the reel;

rotating the grinding wheel about its axis of rotation;

linearly translating the grinding wheel along a longitudinal path; and rotating the reel about its longitudinal axis;

wherein positioning the grinding wheel in contact with the reel blade comprises:

positioning the grinding wheel so that the axis of rotation of the grinding wheel is transverse to a cutting edge of the reel blade, and rotation of the grinding wheel is along a cutting surface of the reel blade, and tangentially contacting the cutting surface of the reel blade with an outer surface of the grinding wheel, wherein the reel blade has a relief surface on one side of the reel blade and a cutting surface having a cutting edge on a distal end of the reel blade, and the step of positioning the grinding wheel includes positioning the grinding wheel so that the axis of rotation of the grinding wheel is transverse to the cutting edge on the distal end of the reel blade, and wherein the outer surface of the grinding wheel contacting the cutting surface of the reel blade is a curved grinding surface.

* * * * *